US008615190B2

(12) United States Patent
Lu

(10) Patent No.: US 8,615,190 B2
(45) Date of Patent: Dec. 24, 2013

(54) SYSTEM AND METHOD FOR ALLOCATING JAMMING ENERGY BASED ON THREE-DIMENSIONAL GEOLOCATION OF EMITTERS

(75) Inventor: Ning Hsing Lu, Clifton, NJ (US)

(73) Assignee: Exelis Inc., McLean, VA (US)

( * ) Notice: Subject to any disclaimer, the term of this patent is extended or adjusted under 35 U.S.C. 154(b) by 24 days.

(21) Appl. No.: 13/149,277

(22) Filed: May 31, 2011

(65) Prior Publication Data

US 2012/0309288 A1 Dec. 6, 2012

(51) Int. Cl.
*H04K 3/00* (2006.01)

(52) U.S. Cl.
USPC ..... 455/1; 455/456.1; 455/513; 455/115.3; 455/404.2; 455/456; 342/14; 342/16; 342/17

(58) Field of Classification Search
None
See application file for complete search history.

(56) References Cited

U.S. PATENT DOCUMENTS

| | | | | |
|---|---|---|---|---|
| 4,797,839 | A * | 1/1989 | Powell | 700/90 |
| 5,055,851 | A | 10/1991 | Sheffer | |
| 5,767,804 | A | 6/1998 | Murphy | |
| 5,987,329 | A | 11/1999 | Yost et al. | |
| 6,018,312 | A | 1/2000 | Haworth | |
| 6,141,558 | A | 10/2000 | Chen | |
| 6,259,404 | B1 | 7/2001 | Parl et al. | |
| 6,414,634 | B1 | 7/2002 | Tekinay | |
| 6,865,490 | B2 | 3/2005 | Cauwenberghs et al. | |
| 7,071,791 | B1 * | 7/2006 | Wilson, III | 333/17.1 |
| 7,292,189 | B2 | 11/2007 | Orr et al. | |
| 7,564,408 | B2 | 7/2009 | Glockler et al. | |
| 7,616,155 | B2 | 11/2009 | Bull et al. | |
| 7,623,871 | B2 | 11/2009 | Sheynblat | |
| 2001/0053699 | A1 | 12/2001 | McCrady et al. | |
| 2003/0204380 | A1 | 10/2003 | Dishman et al. | |
| 2004/0029558 | A1 | 2/2004 | Liu | |
| 2004/0174258 | A1 | 9/2004 | Edelstein et al. | |
| 2004/0233100 | A1 | 11/2004 | Dibble et al. | |
| 2005/0077424 | A1 | 4/2005 | Schneider | |
| 2005/0242995 | A1 * | 11/2005 | Ferreol et al. | 342/463 |
| 2005/0281363 | A1 | 12/2005 | Qi et al. | |
| 2006/0038677 | A1 * | 2/2006 | Diener et al. | 340/540 |
| 2006/0128311 | A1 | 6/2006 | Tesfai | |

(Continued)

FOREIGN PATENT DOCUMENTS

WO 2007063537 A1 6/2007

OTHER PUBLICATIONS

European Search Report, EP12159186, Jul. 11, 2012, 6 pages.

(Continued)

*Primary Examiner* — Yuwen Pan
*Assistant Examiner* — Fanghwa Wang
(74) *Attorney, Agent, or Firm* — Edell, Shapiro & Finnan LLC

(57) ABSTRACT

According to an embodiment of the present invention jamming energy is allocated to a plurality of emitters based on a three-dimensional (3-D) emitter geolocation technique that determines the geolocation of radio frequency (RF) emitters based on energy or received signal strength (RSS) and/or time differences of arrival (TDOAs) of transmitted signals. The three-dimensional (3-D) emitter geolocations are used to rank emitters of interest according to distance and available radio frequency (RF) jamming energy is allocated to the emitters in rank order. The techniques may be employed with small unmanned air vehicles (UAV), and obtains efficient use of jamming energy when applied to radio frequency (RF) emitters of interest.

28 Claims, 5 Drawing Sheets

(56) References Cited

U.S. PATENT DOCUMENTS

| | | | | |
|---|---|---|---|---|
| 2006/0240839 | A1* | 10/2006 | Chen et al. | 455/456.1 |
| 2007/0069949 | A1 | 3/2007 | Ferreol et al. | |
| 2007/0115175 | A1 | 5/2007 | Velicer et al. | |
| 2008/0129600 | A1 | 6/2008 | Thomas | |
| 2008/0186235 | A1 | 8/2008 | Struckman et al. | |
| 2009/0146881 | A1* | 6/2009 | Mesecher | 342/378 |
| 2010/0034133 | A1 | 2/2010 | Marom et al. | |
| 2010/0106745 | A1 | 4/2010 | Cho et al. | |
| 2010/0151810 | A1 | 6/2010 | Besoli et al. | |
| 2010/0190507 | A1 | 7/2010 | Karabinis et al. | |
| 2010/0284359 | A1 | 11/2010 | Kim et al. | |
| 2011/0199916 | A1 | 8/2011 | Garrett et al. | |
| 2012/0235864 | A1 | 9/2012 | Lu | |
| 2012/0293371 | A1 | 11/2012 | Lu | |
| 2013/0027251 | A1 | 1/2013 | Lu et al. | |

OTHER PUBLICATIONS

Robinson et al., "Received Signal Strength Base Location Estimation of a Wireless Lan Client", IEEE Communications Society, Wireless Communications and Networking Conference 2005, pp. 2350-2354.
Wikipedia Article, "Multilateration", Feb. 17, 2010 version, pp. 1-5.
Wikipedia Article, "Trilateration", Feb. 9, 2010 version, pp. 1-3.
Lu, "A Signal-To-Noise Ratio Enhancer", SAS 2011—IEEE Sensors Application Symposium, Feb. 22-24, 2011, 5 pages.
Xinrong Li, "RSS-Based Location Estimation With Unknown Pathloss Model", IEEE Transactions on Wireless Communications, vol. 5, No. 12, Dec. 2006; pp. 3626-3633.
Ralph O. Schmidt, "Multiple Emitter Location and Signal Parameter Estimation", IEEE Transactions on Antennas and Propagation, vol. AP-34, No. 3, Mar. 1986; pp. 276-280.
George V. Serebryakov, "Direction-of-Arrival Estimation of Correlated Sources by Adaptive Beamforming", IEEE Transactions on Signal Processing, vol. 43, No. 11, Nov. 1995; pp. 2782-2787.
Yihong Qi et al., "On Time-of-Arrival Positioning in a Multipath Environment", IEEE Transactions on Vehicular Technology, vol. 55, No. 5, Sep. 2006; pp. 1516-1526.
A. Tennant et al., "Direction Finding Using a Four-Element Time-Switched Array System", 2008 Loughborough Antennas & Propogation Conference; Mar. 17-18, 2008, Loughborough, UK; 2008 IEEE; pp. 181-184.
A. Tennant et al., "A Two-Element Time-Modulated Array With Direction-Finding Properties", IEEE Antennas and Wireless Propagation Letters, vol. 6, 2007; pp. 64-65.
Harry Urkowitz, "Energy Detection of Unknown Deterministic Signals", Proceedings of the IEEE, vol. 55, No. 4, Apr. 1967; pp. 523-531.
Ning H. Lu, "Linearized, Unified Two-Ray Formulation for Propagation over a Plane Earth", Sicon/05—Sensors for Industry Conference; Houston, Texas, USA, Feb. 8-10, 2005.
Guolin Sun et al., "Signal Processing Techniques in Network-Aided Positioning", IEEE Signal Processing Magazine Jul. 12, 2005.
Bo-Chieh Liu et al., "Analysis of Hyperbolic and Circular Positioning Algorithms Using Stationary Signal-Strength-Difference Measurements in Wireless Communications", IEEE Transactions on Vehicular Technology, vol. 55, No. 2, Mar. 2006; pp. 499-509.
Ada S. Y. Poon et al., "Degrees of Freedom in Multiple-Antenna Channels: A Signal Space Approach", IEEE Transaction Information Theory Society, vol. 51, Issue 2.
Seungjin Choi, "Blind Source Separation and Independent Component Analysis: A Review", Neural Information Processing-Letters and Review, vol. 6, No. 1, Jan. 2005, pp. 1-57.
Ludwig Rota et al., "Parallel Deflation with Alphabet-Based Criteria for Blind Source Extraction", Proc. SSP-2005, 13th IEEE Workshop on Statistical Signal Processing, Jul. 2005, pp. 1-5.
J. Durbin et al., "Time series analysis of non-Gaussian observations based on state space models from both classical and Bayesian perspectives", Dec. 1998, pp. 1-26.
Shlomo Dubnov, "Generalization of Spectral Flatness Measure for Non-Gaussian Linear Processes", Oct. 30, 2002, pp. 1-6.
M. Ryyan Khan et al., "Iterative Noise Power Subtraction Technique for Improved SNR in Speech Enhancement", pp. 1-3.
Fredrik Gustafsson et al., "Positioning Using Time-Difference of Arrival Measurements", pp. 1-4.
European Search Report, EP1216677, Sep. 12, 2012, 6 pages.
European Search Report, EP12166578, Oct. 1, 2012, 6 pages.
Cardoso, "Blind Signal Separation: Statistical Principles", Proceedings of the IEEE, vol. 86, No. 10, Oct. 1998, pp. 2009-2025.
Buchner et al, "A Generalization of Blind Source Separation Algorithms for Convolutive Mixtures Based on Second-Order Statistics," IEEE Trans. on Speech and Audio Processing, vol. 13, No. 1, Jan. 2005, pp. 120-134.
Ukai et al, "Multistage SIMO-Model-Based Blind Source Separation Combining Frequency Domain ICA and Time Domain ICA," IEEE International Conference on Acoustics, Speech, and Signal Processing, vol. 4, 2004, pp. 109-112.
Aichner et al, "Post Processing for Convolutive Blind Source Separation," Proc. IEEE Internatinal Conf Acoustics, Speech, Signal Processing (ICASSP), vol. 5, pp. 37-40, May 2006.

* cited by examiner

SYSTEM AND METHOD FOR ALLOCATING JAMMING ENERGY BASED ON THREE-DIMENSIONAL GEOLOCATION OF EMITTERS

BACKGROUND

1. Technical Field

The present invention embodiments pertain to allocating jamming energy. In particular, the present invention embodiments pertain to emitter rank and jamming energy allocation based on the locations of radio frequency (RF) emitters in a three-dimensional space. Emitter location is determined using various methods, e.g., energy, received signal strength (RSS), or time difference of arrival (TDOA) measurements, of the emitter at various measurement locations.

2. Discussion of Related Art

Conventional electronic warfare (EW) systems use either a "blind" offensive electronic counter measures (ECM) approach or a "smart" directional approach to jamming radio frequency (RF) signals. The blind electronic counter measures (ECM) approach uses omnidirectional radio frequency (RF) emissions that may not be effective on critical emitters and wastes energy by blanketing a coverage area. The smart directional electronic counter measures (ECM) approach directs radio frequency (RF) energy to a specific emitter but requires an expanded processing bandwidth, a long processing latency, and added system resources, e.g., processors and memory capacity, in order to properly target the emitter of interest.

SUMMARY

An embodiment of the present invention pertains to allocating jamming energy to emitters of interest. To allocate jamming energy the emitters are ranked, in part, using a three-dimensional (3-D) emitter direction finding (DF) and geolocation technique that determines the geolocation of a radio frequency (RF) emitter based on energy or time differences of arrival (TDOAs) of transmitted signals. The geolocation provides range or distance, and relative bearing to an emitter of interest which can be used to generate emitter coordinates and elevation. The technique may be employed with small unmanned aerial vehicles (UAV), and obtains reliable geolocation estimates of radio frequency (RF) emitters of interest. The three dimensional (3-D) geolocation technique is then used to rank emitters of interest for jamming operations based on the range and bearing to the emitter. An emitter ranking and energy allocation strategy is used to allocate the system resources to maximize system effectiveness. The emitter ranking and energy allocation strategy allocates enough jamming energy to the highest ranking emitter until that emitter's capability is mitigated, then energy is allocated to the next highest ranking emitter until that emitter's capability is mitigated, etc. The process continues until the available jamming energy is exhausted.

Present invention embodiments provide several advantages. For example, the technique of present invention embodiments provides the simplicity and the performance robustness required by a low-cost, compact system. The use of a small unmanned air vehicle (UAV) provides a cost-effective manner to reliably measure received signal strength (RSS) data generated from the radio frequency (RF) emitters of interest, generate geolocation information from the RSS data, and then use the geolocation information to rank and prioritize the emitters of interest for jamming purposes. In addition, the combination of the technique with the use of an unmanned air vehicle (UAV) enables an overall system to be small, compact, flexible, reliable, and of low-cost.

Moreover, the unmanned air vehicle (UAV) system provides the following advantages: radio frequency (RF) emitters are quickly discriminated from background radio frequency (RF) noise and benign signals; the line of bearing (LOB) to emitters is quickly attained using (direction finding (DF)) to maximize the overall jamming effects; the geolocation of emitters is quickly attained and displayed/reported when needed; unintentional emissions from emitters are quickly located; the radio frequency (RF) environment may be mapped rapidly to provide organic radio frequency (RF) situational awareness (SA) for signal processing; geo-spatial information is correlated with known information to identify emitters; emitters can be detected during the making or pre-deployment of the emitter devices or platforms; and post-processing and post-analysis may be performed to notify of potential situations.

The above and still further features and advantages of present invention embodiments will become apparent upon consideration of the following detailed description of example embodiments thereof, particularly when taken in conjunction with the accompanying drawings wherein like reference numerals in the various figures are utilized to designate like components.

DETAILED DESCRIPTION OF EXAMPLE EMBODIMENTS

Embodiments of the present invention pertain to a jamming system that employs a three-dimensional (3-D) geolocation technique to obtain reliable geolocation estimates of a radio frequency (RF) emitter and uses the geolocation and other information to optimize jamming efforts. The geolocation of a radio frequency (RF) emitter is a critical need for many applications including identifying emitters to receive jamming energy. The technique of present invention embodiments may be employed with unmanned air vehicles (UAV) that are usually small, utilized for low altitudes, and employ typical guidance technologies for operation (e.g., following pre-planned or manually provided paths or waypoints). These types of vehicles are well suited for enabling three-dimensional (3-D) geolocation of radio frequency (RF) emitters of interest and jamming their emissions.

Figure 1:
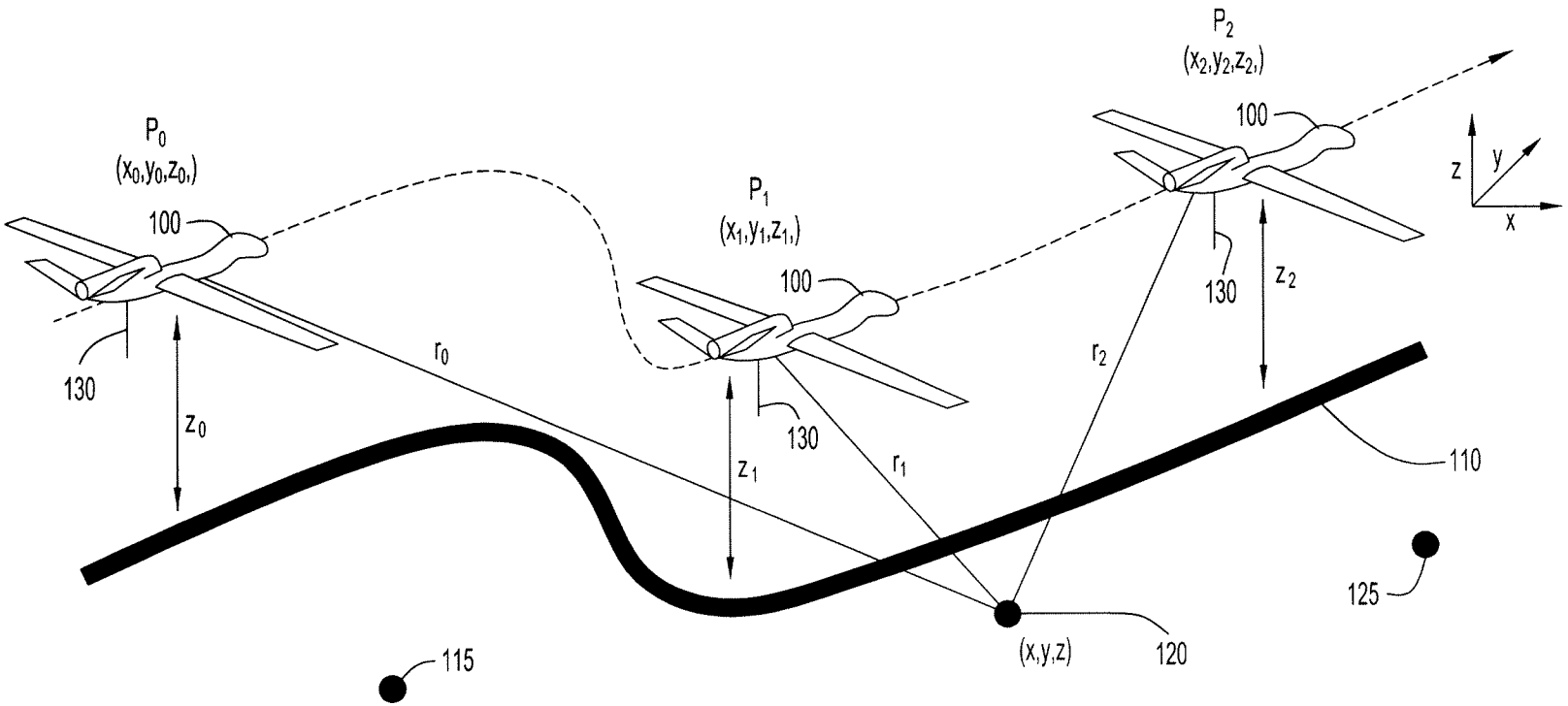
FIG. 1 is a diagrammatic illustration of an example environment for determining geolocation of a radio frequency (RF) emitter according to an embodiment of the present invention.

An example environment for determining the geolocation of a target radio frequency (RF) emitter in a three-dimensional space is illustrated in FIG. 1. Specifically, the environment includes a radio frequency (RF) emitter 120, a mobile sensor 100 (e.g., an unmanned air vehicle (UAV) or other platform with a radio frequency (RF) sensor, etc.), and two potential emitters 115 and 125 that are currently not emitting detectable radio frequency (RF) energy. At this point in time, mobile sensor 100 is content to remain in the area of radio frequency (RF) emitter 120, track its position, and optionally relay position and other intelligence to a command and control center.

The mobile sensor travels along a pre-planned path 110 (e.g., a pre-planned flight path in the case of an unmanned air vehicle (UAV)). Mobile sensor 100 includes an antenna 130 that receives signals from radio frequency (RF) emitter 120 in order to measure the strength of those signals and their time differences of arrival (TDOAs). Each of the energy-based and time difference of arrival (TDOA) geolocation techniques are described in turn below. The radio frequency (RF) emitter and mobile sensor are located within a three-dimensional space of the environment (e.g., defined by X, Y, and Z axes as illustrated in FIG. 1). Locations within the three-dimensional space may be represented by coordinates that indicate a position along each of the respective X, Y, and Z axes. By way of example, radio frequency (RF) emitter 120 is positioned at an unknown location (x, y, z) within the three-dimensional space, while mobile sensor 100 receives signals transmitted from the radio frequency (RF) emitter at known locations along path 110 within the three-dimensional space (e.g., locations $(x_0, y_0, z_0)$, $(x_1, y_1, z_1)$, and $(x_2, y_2, z_2)$ as viewed in FIG. 1). The Z axis represents the height or altitude, and indicates the offset between the mobile sensor and pre-planned path 110 (e.g., distances $z_0$, $z_1$, $z_2$ as viewed in FIG. 1).

Mobile sensor 100 measures at selected locations (e.g., $(x_0, y_0, z_0)$, $(x_1, y_1, z_1)$, and $(x_2, y_2, z_2)$ as viewed in FIG. 1) the received signal strength (RSS) (e.g., $p_0$, $p_1$, $p_2$ as viewed in FIG. 1) of radio frequency (RF) signals emitted by emitter 120. The received signal strength (RSS) at each location is proportional to the distance (e.g., $r_0$, $r_1$, $r_2$ as viewed in FIG. 1) between that location and radio frequency (RF) emitter 120. The received signal strength (RSS) measurement can be viewed as a special case of the signal energy in which only a single signal sample is used for the measurement at each location. Each RSS measurement that feeds the geolocation algorithm is the measurement with the maximum signal to noise ratio selected from a block of consecutive RSS data (which is referred to herein as the maximum signal to noise ratio (MSNR) rule). The block size can be determined using the assessment of the spaced-frequency spaced-time correlation function of the propagation channel.

Once mobile sensor 100 collects the received signal strength (RSS) measurements, the geolocation estimate of radio frequency (RF) emitter 120 is determined based on those measurements as described below. The received signal strength (RSS) measurements may be collected by using an unmanned air vehicle (UAV) or other platform along a flight or other pre-planned path, or by using plural unmanned air vehicles (UAV) or other platforms each collecting a measurement at one or more locations along that path. In other words, measurements from plural locations may be ascertained via a single platform traveling to different locations, or via plural platforms each positioned at different locations and networking or otherwise sharing the collected data for the geolocation determination. Since measurement errors exist due to path loss modeling, signal fading, shadowing effects, noise/interference, antenna pattern effects, time-varying channel and transmit power effects, and implementation errors, a Least Mean Square (LMS) technique is preferably employed to determine the location of radio frequency (RF) emitter 120 as described below. Although FIG. 1, by way of example only, indicates measurements at certain locations (e.g., $(x_0, y_0, z_0)$, $(x_1, y_1, z_1)$, and $(x_2, y_2, z_2)$ as viewed in FIG. 1), any quantity of received signal strength (RSS) measurements (e.g., $p_1$, where i=0 to N) may be collected at any corresponding locations ($(x_i, y_i, z_i)$, where i=0 to N) within the three-dimensional space.

Present invention embodiments resolve the location of radio frequency (RF) emitter 120 by estimating the energy or received signal strength (RSS) of signals emitted from emitter 120 via the received signal strength (RSS) measurements ascertained from plural locations (e.g., $p_0$, $p_1$, $p_2$ measured at locations $(x_0, y_0, z_0)$, $(x_1, y_1, z_1)$, and $(x_2, y_2, z_2)$ as viewed in FIG. 1) along path 110. The received signal strength (RSS) measurements are each proportional to the distance between the location of that measurement and radio frequency (RF) emitter 120 (e.g., $r_0$, $r_1$, $r_2$ as viewed in FIG. 1) as described above. The measurements are utilized in a set of simultaneous equations to determine the location of the radio frequency (RF) emitter within the three-dimensional space as described below.

Mobile sensor 100 uses a processing block that includes one or more location modules to compute geolocation data for each emitter within a given area. Initially, one or more mobile sensors 100 measure received signal strength (RSS) of signals emitted from radio frequency (RF) emitter 120 at one or more locations (e.g., locations from 0 through N as described below) along path 110. Note that indices in the equations or references described below may range from 0 to N with respect a number of measurement locations or 1 to N when referenced with respect to location 0. A set of simultaneous equations to determine the geolocation of the radio frequency (RF) emitter based on the received signal strength (RSS) measurements are determined, and converted into matrix form. In particular, the location of radio frequency (RF) emitter 120 within the three-dimensional space may be represented by the coordinates (x, y, z), while the position of mobile sensor 100 ascertaining a measurement at an $i^{th}$ location along path 110 may be represented by the coordinates $(x_i, y_i, z_i)$. The distance, $r_i$, in the three-dimensional space between the location of the radio (RF) frequency emitter (e.g., (x, y, z)) and the $i^{th}$ measuring location (e.g., $(x_i, y_i, z_i)$), may be expressed as the following:

$$r_1^2=(x-x_i)^2+(y-y_i)^2+(z-z_i)^2;\ \text{for } i=0 \text{ to } N. \qquad \text{(Equation 1)}$$

The distance (e.g., $d_i$, for i=0 to N) between a reference origin in the three-dimensional space (e.g., (0, 0, 0)) and a location of mobile sensor 100 (e.g., $(x_i, y_i, z_i)$) may be expressed as the following:

$$d_i^2=x_i^2+y_i^2+z_i^2;\ \text{for } i=0 \text{ to } N. \qquad \text{(Equation 2)}$$

The difference of the square of the distances (e.g., $r_i^2-r_0^2$) for the $i^{th}$ measuring location (e.g., $(x_i, y_i, z_i)$) and an arbitrary reference location of mobile sensor 100 (e.g., $(x_0, y_0, z_0)$) may be expressed (based on Equations 1 and 2) as the following:

$$r_i^2-r_0^2=d_i^2-d_0^2-2x(x_i-x_0)-2y(y_i-y_0)-2z(z_i-z_0),\ \text{for } i=1 \text{ to } N, \qquad \text{(Equation 3)}$$

where this equation (Equation 3) may be equivalently expressed as the following equation:

$$\left[\frac{r_i^2}{r_0^2}-1\right]r_0^2+2x(x_i-x_0)+2y(y_i-y_0)+2z(z_i-z_0)=d_i^2-d_0^2. \quad \text{(Equation 4)}$$

The above equation (Equation 4) may be simplified by employing a parameter, $\beta_i$, which corresponds to the $i^{th}$ measuring location, and may be expressed as follows:

$$\beta_i=\left[\frac{r_i^2}{r_0^2}-1\right], \text{ for } i=1 \text{ to } N. \quad \text{(Equation 5)}$$

In addition, the terms of the above equation (Equation 4) may be converted to matrix form and employ the parameter, $\beta_i$(from Equation 5). The equation terms may be expressed by matrices P (e.g., representing terms on the left side of the equal sign in Equation 4) and R (e.g., representing terms on the right side of the equal sign in Equation 4) as follows:

$$P=\begin{bmatrix}\beta_1 & 2(x_1-x_0) & 2(y_1-y_0) & 2(z_1-z_0)\\ \beta_2 & 2(x_2-x_0) & 2(y_2-y_0) & 2(z_2-z_0)\\ \vdots & \vdots & \vdots & \vdots\\ \beta_N & 2(x_N-x_0) & 2(y_N-y_0) & 2(z_N-z_0)\end{bmatrix}, R=\begin{bmatrix}d_1^2-d_0^2\\ d_2^2-d_0^2\\ \vdots\\ d_N^2-d_0^2\end{bmatrix}$$

The overall equation (Equation 4) may be represented by the following matrix equation:

$$P\cdot\begin{bmatrix}r_0^2\\ x\\ y\\ z\end{bmatrix}=R \quad \text{(Equation 6)}$$

The terms $x_i$, $y_i$, $z_i$, (for i=0 to N) within matrix P represent the known positions or coordinates in the three-dimensional space where mobile sensor 100 ascertains the received signal strength (RSS) measurements, while the terms $r_0^2$, x, y, and z in the solution matrix are unknown and to be solved by the above equation (Equation 6). The determined values for x, y, and z represent the coordinates (or location) of radio frequency (RF) emitter 120 within the three-dimensional space, while the determined value for $r_0^2$ represents the square of the distance between radio frequency (RF) emitter 120 and the known reference location (e.g., at coordinates $x_0$, $y_0$, and $z_0$ within the three-dimensional space) of mobile sensor 100.

The values for the unknown variables (e.g., $r_0^2$, x, y, and z) indicating the location of radio frequency (RF) emitter 120 may be determined by solving for these variables in Equation 6, thereby providing the following expression:

$$\begin{bmatrix}r_0^2\\ x\\ y\\ z\end{bmatrix}=(P^TP)^{-1}P^TR, \quad \text{(Equation 7)}$$

where $P^T$ represents the transpose of matrix P, and $(P^TP)^{-1}$ represents the inverse of the product of matrix P and the transpose of matrix P.

In order to determine the unknown variables (e.g., $r_0^2$, x, y, and z) indicating the location of radio frequency (RF) emitter 120 in the above equation (Equation 7), the parameter, $\beta_i$, of matrix P may be estimated based on the measurements of received signal strength (RSS) obtained by mobile sensor 100. Considering the line of sight (LOS) propagation loss between mobile sensor 100 (e.g., unmanned air vehicle (UAV)) and radio frequency (RF) emitter 120, the received signal power, $p_i$, at the $i^{th}$ location along path 110 is inversely proportional to the square law of the distance, $r_i$, between the mobile sensor (e.g., unmanned air vehicle (UAV)) and the radio frequency (RF) emitter. Assuming the power of radio frequency (RF) emitter 120 remains constant during the measurements of received signal strength (RSS) along path 110, the parameter, $\beta_i$, may be estimated based on the received signal strength (RSS) or power measurements as follows:

$$\beta_i=\left[\frac{r_i^2}{r_0^2}-1\right]\cong\left[\frac{p_0}{p_i}-1\right], \text{ for } i=1 \text{ to } N. \quad \text{(Equation 8)}$$

At least four independent equations (or at least four rows of matrices P and R) are required to determine the four unknown variables (e.g., $r_0^2$, x, y, and z) and, hence, the location of radio frequency (RF) emitter 120. However, measurements from at least five locations are required to provide estimates for the parameter, $\beta_i$ (e.g., a reference measurement for $p_0$, and a measurement for each $p_i$, for i=1 to 4).

The estimates for the parameter, $\beta_i$ (for i=1 to N), and the various terms that can be derived from the known measuring locations of mobile sensor 100 (e.g., $x_i$, $y_i$, $z_i$ (for i=0 to N); $d_i^2$ (for i=0 to N), etc.) are applied to matrices P and R. The applied values within matrices P and R are utilized in Equation 7 to determine the values for the unknown variables (e.g., $r_0^2$, x, y, and z) in the solution matrix. Since there are path loss model errors, signal fading and/or shadowing effects, noise, interference, and implementation errors that impact the measurement, the above determination (Equations 1-7) is formulated to provide a Least Mean Square (LMS) solution for the variables in the solution matrix.

The determined Least Mean Square (LMS) values for x, y, and z within the solution matrix (derived from Equation 7) represent the coordinates of radio frequency (RF) emitter 120 within the three-dimensional space, and are utilized to provide the Least Mean Square (LMS) location of the radio frequency (RF) emitter within that space. Further examples of the energy based geolocation technique described above may be found in U.S. patent application Ser. No. 13/049,443, entitled "System and Method for Three-Dimensional Geolocation of Emitters Based on Energy Measurements" and filed on Mar. 16, 2011, the entirety of which is incorporated by reference herein and in U.S. patent application Ser. No. 12/710,802, entitled "System of Systems Approach for Direction Finding and Geolocation" and filed on Feb. 23, 2010, the entirety of which is incorporated by reference herein.

Time difference of arrival (TDOA) techniques may be further utilized to perform geolocation of radio frequency (RF) emitters. Time differences of arrivals follow hyperbolic curves to establish a range difference ($\Delta r$) based on the time difference of arrival ($\Delta t$) of emitter signals. Since $\Delta r=c\Delta t$, where c denotes the speed of light, $\Delta r$ can be computed from $\Delta t$, where $\Delta t$ is equal to time of arrival $t_1$ at a first measurement location minus time of arrival $t_2$ at a second measurement location ($t_1-t_2$).

The time difference of arrival geolocation (TDOAG) algorithm described below uses the same reference coordinate system (FIG. 1) and notation used to describe the energy-based geolocation algorithm. The position of mobile sensor 100 ascertaining a measurement at an $i^{th}$ location along path 110 may be represented by the coordinates $(x_i, y_i, z_i)$. The distance, in the three-dimensional space between the location (e.g., (x, y, z)) of the radio (RF) frequency emitter (e.g., emitter 120) and the $i^{th}$ measuring location (e.g., $(x_i, y_i, z_i)$), may be expressed as the following:

$$r_i^2=(x-x_i)^2+(y-y_i)^2+(z-z_i)^2;\ \text{for } i=0 \text{ to } N. \quad \text{(Equation 9)}$$

The distance (e.g., $d_i$, for i=0 to N) between a reference origin in the three-dimensional space (e.g., (0, 0, 0)) and a location of mobile sensor 100 (e.g., $(x_i, y_i, z_i)$) may be expressed as the following:

$$d_i^2=x_i^2+y_i^2+z_i^2;\ \text{for } i=0 \text{ to } N. \quad \text{(Equation 10)}$$

When i=0, the reference location, the range from the emitter to the reference location is:

$$r_0^2=(x-x_0)^2+(y-y_0)^2+(z-z_0)^2$$

The range difference from the emitter to $i^{th}$ location and to the reference location is:

$$\Delta r_i=r_i-r_0 \text{ (which is also equal to } c(t_i-t_0))$$

Rearranging the terms and squaring yields:

$$(r_0+\Delta r_i)^2=r_i^2$$

Expanding the terms and adding the equivalence from Equation 10 yields:

$$(r_0+\Delta r_i)^2=r_0^2+2r_0\Delta r_i+(\Delta r_i)^2=r_i^2=(x-x_i)^2+(y-y_i)^2+(z-z_i)^2$$

And in simplified form:

$$r_0^2+2r_0\Delta r_i+(\Delta r_i)^2=(x-x_i)^2+(y-y_i)^2+(z-z_i)^2 \quad \text{(Equation 11)}$$

Again from Equation 10, let $d_i^2=x_i^2+y_i^2+z_i^2$; for i=0 to N. Subtracting Equation 10 from Equation 11 gives the following equation:

$$2r_0\Delta r_i+(\Delta r_i)^2=d_i^2-d_0^2-2[x(x_i-x_0)+y(y_i-y_0)+z(z_i-z_0)]$$

Rearranging the terms yields:

$$2[x(x_i-x_0)+y(y_i-y_0)+z(z_i-z_0)]+2r_0\Delta r_i=d_i^2-d_0^2-(\Delta r_i)^2 \quad \text{(Equation 12)}$$

Equation 12 lends itself to matrix formulation. The time difference of arrival geolocation (TDOAG) algorithm can be formulated in a matrix format, P·U=R:

$$P=\begin{bmatrix} 2\Delta r_1 & 2(x_1-x_0) & 2(y_1-y_0) & 2(z_1-z_0) \\ 2\Delta r_2 & 2(x_2-x_0) & 2(y_2-y_0) & 2(z_2-z_0) \\ \vdots & \vdots & \vdots & \vdots \\ 2\Delta r_N & 2(x_N-x_0) & 2(y_N-y_0) & 2(z_N-z_0) \end{bmatrix}; \quad \text{(Equation 13)}$$

$$U=\begin{bmatrix} r_0 \\ x \\ y \\ z \end{bmatrix}; \text{ and}$$

$$R=\begin{bmatrix} d_1^2-d_0^2-(\Delta r_1)^2 \\ d_2^2-d_0^2-(\Delta r_2)^2 \\ \vdots \\ d_N^2-d_0^2-(\Delta r_N)^2 \end{bmatrix},$$

The four unknowns in matrix U (Equation 13) can be solved with at least 4 independent equations with the measurements from 5 independent locations. Note that the variables $(x_0, y_0, z_0)$ and $(x_1, y_1, z_1)$ to $(x_N, y_N, z_N)$ in matrix P are known and relate to the locations of the signal measurements, while the variables $\Delta r_1$-$\Delta r_N$ and $d_0$-$d_N$ in matrices P and R are computed as described above from known values.

Further information regarding of a suitable time difference of arrival (TDOA) geolocation technique as mentioned above may be found in U.S. patent application Ser. No. 13/111,379, entitled "System and Method for Geolocation of Multiple Unknown Radio Frequency Signal Sources" and filed on May 19, 2011, the entirety of which is incorporated by reference herein.

Figure 2:
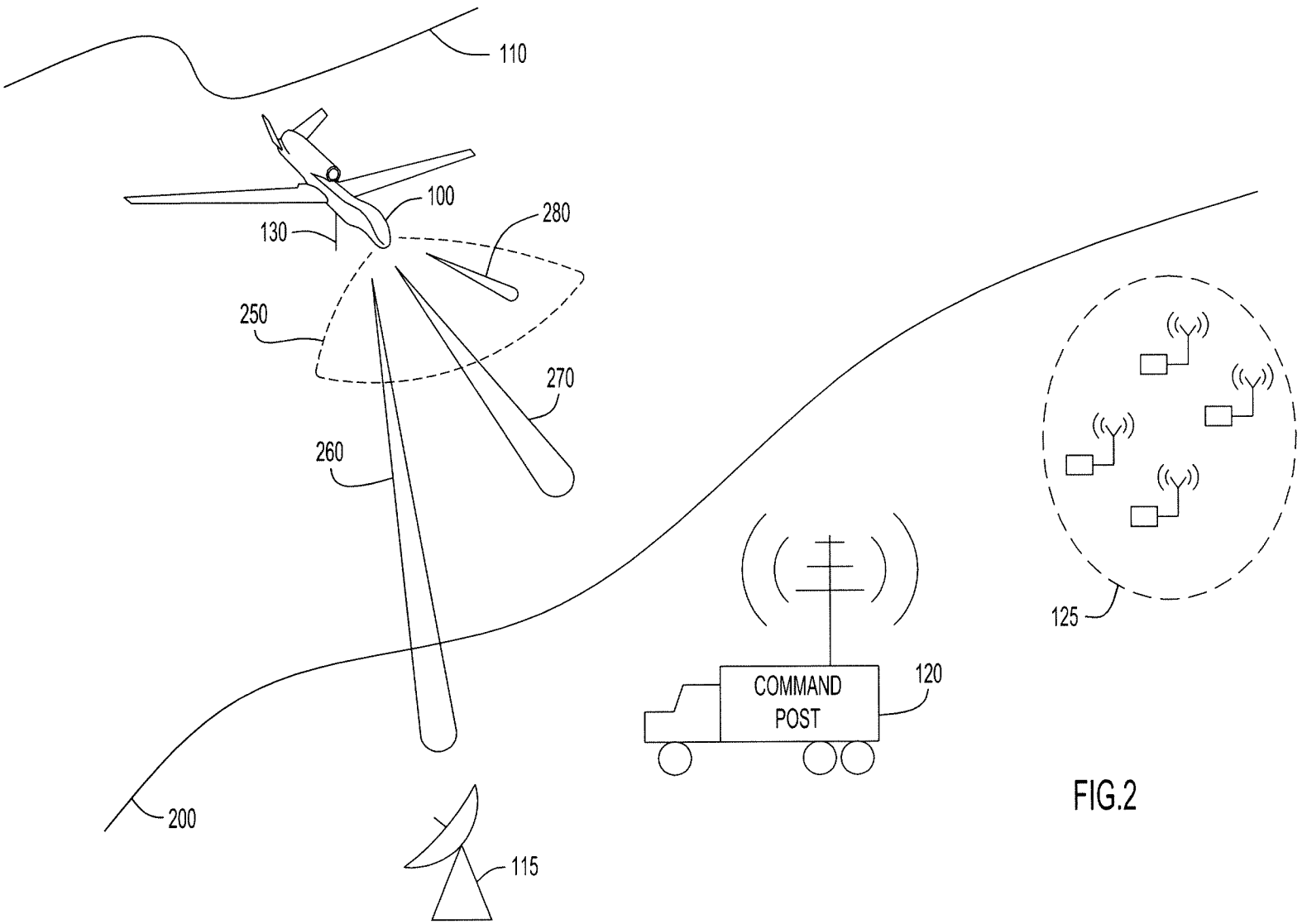
FIG. 2 is a diagrammatic illustration of the example environment from FIG. 1 with additional detail for allocating jamming energy to an emitter according to an embodiment of the present invention.

The geolocation techniques described above may be applied to locate and jam emitters. The example environment of FIG. 1 is illustrated in FIG. 2 with additional details about the environment for applying geolocation of radio frequency (RF) emitters to jamming operations. Specifically, the environment includes a demarcation line 200 that provides emitters of interest. Potential emitter 115 may be a radar or tracking system 115 and potential emitter 125 may be a deployment 125 of portable units. Mobile sensor 100 is equipped with jamming capability (e.g., an unmanned air vehicle (UAV) or other platform with a radio frequency (RF) sensor and jamming capability).

In the example shown in FIG. 2, mobile sensor 100 may patrol to locate radio frequency (RF) transmissions or unintentional RF emissions. The mobile sensor 100 performs an emitter analysis on each of the received emissions and ranks the emissions in order of importance. Alternatively, mobile sensor 100 may stumble upon certain emissions of interest. As described above, mobile sensor 100 is monitoring command post 120. At some point in time, tracking system 115 is activated and starts emitting radar signals. Mobile sensor 100 immediately deviates from the flight plan along path 110 and initiates offensive semi-omnidirectional jamming. This is shown by radiation pattern 250 emanating from the front of mobile sensor 100.

During semi-omnidirectional jamming, mobile sensor 100 continues to analyze emissions within its domain. Mobile sensor 100 detects emissions from deployment 125, as well as from tracking system 115 and mobile command post 120. Mobile sensor 100 can determine the function of tracking system 115 based on the radio frequency (RF) spectrum in use by tracking system 115 and how the radio frequency (RF) spectrum is employed (e.g., frequency hopping). Command post 120 offers command and control to both tracking system 115 and deployment 125. Deployment 125 may include portable radio frequency devices or vehicles.

The mobile sensor analyzes the potential of each emitter with respect to other entities. The analysis may be based on a concept term herein as "situational awareness" or SA. Situational awareness is the perception of elements in the environment within a volume of time and space, the comprehension of their meaning, and the projection of their status in the near future. Thus, situational awareness requires an ongoing assessment of the current situation as well as estimates of the situation in the near future. Mobile sensor 100 may use internally programmed criteria to rank emitters in the current environment or receive information from an external source.

Example criteria that may be used to rank emitters may include emitter type, distance from the mobile sensor 100 to the emitter, whether the emitter is in front of or to the rear of mobile sensor 100, correlation of the emitter's geospatial properties with information known about the current environment. The criteria may be weighted to form an emitter score (e.g., a weighted average) that is used for emitter ranking. Emitter types with certain characteristics may be given a higher priority (e.g., tracking system 115 may be deemed a higher priority than deployment 125). Emitters that are closer to or in front of the mobile sensor 100 are given a higher priority. Lastly, the emitter's geospatial properties may be correlated with information known about the current environment. Known information may include terrain topology, known enemy operating areas, and satellite imagery or other intelligence.

Mobile sensor 100 may employ additional distance based criteria for ranking or jamming decisions. Mobile sensor 100 may decide not to jam emitters more than H meters away, J meters in front, or K meters to the rear, and give these emitters a lower priority. By way of example, an emitter type may be of utmost jamming priority, but because the emitter is too far distant or in the incorrect azimuthal or elevation plane, the emitter is discarded from the ranking list and ignored for the time being. The emitters that can not be handled by the present system may be relayed to a central authority or "handed off" to another jamming resource (e.g., to another unmanned air vehicle (UAV)) in a coordinated manner.

In the example shown in FIG. 2, mobile sensor 100 has ranked tracking system 115 as the highest priority emitter, command post 120 as the second highest priority emitter, and deployment of portable units 125 are deemed to be the least priority emitters at the current time. Accordingly, mobile sensor 100 transitions from semi-omnidirectional jamming 250 to directional or targeted jamming shown as jamming radio frequency (RF) beams 260, 270, and 280. The length of the jamming beams indicates the relative power of each beam. Mobile sensor 100 uses an emitter ranking and energy allocation strategy to allocate jamming energy to the various emitters. The emitter ranking and energy allocation algorithm starts with the highest priority emitter and allocates sufficient energy to mitigate that emitter based on the estimated distance to that emitter. Then, the algorithm does the same for the second highest priority emitter and allocates the sufficient energy to mitigate that emitter based on the estimated distance to that emitter. This process is repeated until the total energy constraint of the transmitter's high power amplifier (HPA) is exceeded. The situation in the radio frequency (RF) environment is periodically reassessed and the algorithm is repeated.

Mobile sensor 100 first attempts to affect tracking system 115 with jamming beam 260. Mobile sensor 100 assesses the emitter type, emitter signal spectrum, and emitter radio frequency (RF) modulation scheme to determine the appropriate level of jamming energy and the appropriate transmission techniques to employ. For example, radars typically require a larger amount of jamming energy than other types of emitters. Typical radar jamming techniques generate false information at the radar such as a false range, velocity, or angle. Other techniques include noise jamming and burn through to overpower the emitter. Next, mobile sensor 100 attempts to affect command post 120 communications with jamming beam 270. Generally, jamming a communications system requires less power than jamming radar depending on the radio frequency (RF) communication spectrum employed by the communications system. Lastly, mobile sensor 100 attempts to jam deployment 125 communications with jamming beam 280.

Generating jamming beams 260, 270, and 280, may require generating different antenna radiation patterns, selecting antennas and jamming platforms or subsystems (e.g., radar jamming may require a radar jamming subsystem while communication jamming may require a communications jamming subsystem).

Figure 3:
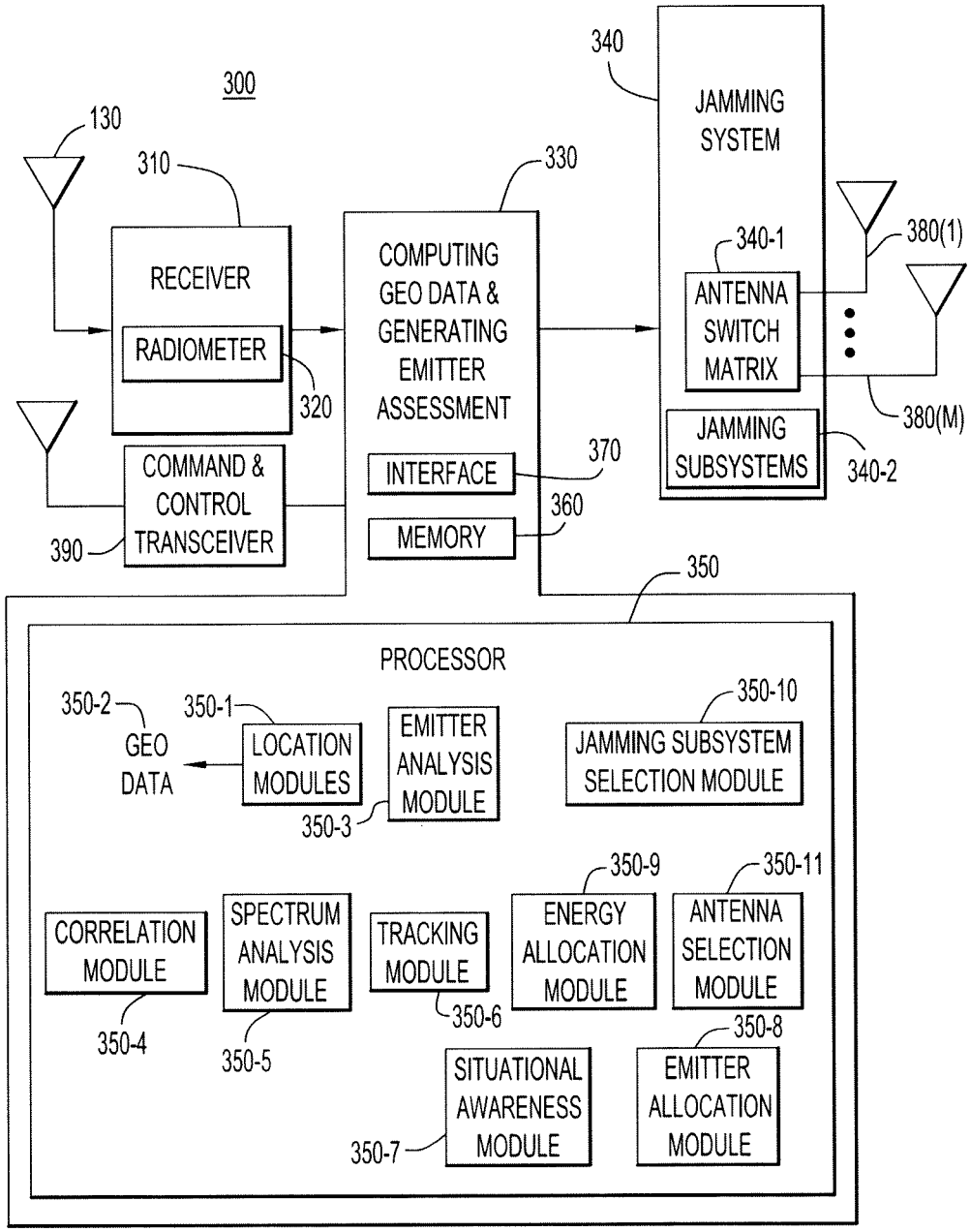
FIG. 3 is a block diagram of a system for determining geolocation of a radio frequency (RF) emitter, emitter ranking, and jamming energy allocation according to an embodiment of the present invention.

An example system 300 for determining the geolocation of a radio frequency (RF) emitter, emitter ranking, and jamming energy allocation according to an embodiment of the present invention is illustrated in FIG. 3. Initially, system 300 preferably resides on mobile sensor 100 (FIGS. 1 and 2) to measure the received signal strength (RSS) and process time differences of arrival (TDOAs), determine the geolocation of the radio frequency (RF) emitter, and perform emitter analysis. However, the processing and one or more other portions of system 300 may be remote from the mobile sensor and receive the received signal strength (RSS) and/or time difference of arrival (TDOA) measurements for the geolocation determination. In particular, system 300 includes antenna 130, a receiver 310, a processing device 330, a jamming system 340, and a command and control transceiver 390. Antenna 130 is preferably implemented by an omni-directional antenna, and directs received signals into receiver 310. The antenna may be implemented by any conventional or other antenna configurable to receive the signals emitted from radio frequency (RF) emitters 115, 120, and 125.

Receiver 310 includes a radiometer or energy detector 320 that provides an energy measure (e.g., received signal strength (RSS)) of the signals received from antenna 130. The receiver may be implemented by any conventional or other receiving device capable of receiving the emitted radio frequency (RF) signals, while the radiometer may be implemented by any conventional or other device to measure the energy or received signal strength (RSS) of a received signal. Based on the MSNR rule, the selected, received signal strength (RSS) measurements are provided to processing device 330 to determine the geolocation of radio frequency (RF) emitters 115, 120, and 125 as described below. As an example, tracking system 115 may "paint" mobile sensor 100 by sweeping a beam of radio frequency (RF) energy along an axis. Accordingly, the radio frequency (RF) energy will peak when the beam is pointed at mobile sensor 100. The MSNR rule allows selection of the received signal strength (RSS) at peak energy.

Processing device 330 may include a processor 350, a memory 360, and an interface unit 370. Processor 350 includes one or more location modules 350-1 to determine the geolocation of radio frequency (RF) emitter 120 based on the measurements received from receiver 310 and to provide corresponding geolocation data 350-2. Location modules 350-1 compute geolocation from a set of simultaneous equations incorporating a Least Mean Square (LMS) and/or time difference of arrival (TDOA) techniques as described above. Processor 350 also includes an emitter analysis module 350-3 to analyze the radio frequency (RF) signals from emitters 115, 120, and 125 based on signals received from receiver 310.

For emitter analysis, processor 350 includes a correlation module 350-4, a spectrum analysis module 350-5, and a tracking module 350-6. The tracking module 350-5 incorporates a situational awareness module 350-7 and an emitter allocation module 350-8. An energy allocation module 350-9 is provided to determine the jamming energy required for a particular emitter. A jamming subsystem selection module 350-10 is provided to select the appropriate jamming subsystem and an antenna selection module 350-11 is provided to select the appropriate jamming antenna. Each of these modules will be described below.

Processor 350 may be implemented by any conventional or other computer or processing unit (e.g., a microprocessor, a microcontroller, systems on a chip (SOCs), fixed or programmable logic, etc.), where any of processing modules 350-1 through 350-11 may be implemented by any combination of any quantity of software and/or hardware modules or units. Memory 360 may be included within or external of processor 350, and may be implemented by any conventional or other memory unit with any type of memory (e.g., random access memory (RAM), read only memory (ROM), etc.). The memory may store the modules 350-1 through 350-11 for execution by processor 350, and data for performing the geolocation and jamming techniques of present invention embodiments. Interface unit 370 enables communication between system 300 and other devices or systems, and may be implemented by any conventional or other communications device (e.g., wireless communications device, etc.).

The jamming system 340 has an antenna switch matrix 340-1 coupled to a plurality of antennas 380(1)-380(M), and a one or more jamming subsystems 340-2. The plurality of antennas 380(1)-380(M) may include omni-directional antennas, directional antennas, and smart or phased-array antennas. Each antenna may be adapted for a particular use, cover a range of radio frequencies, or cover a particular area (e.g., fore or aft of mobile sensor 100). By way of example, it may be desirable to perform a terrain bounce jamming technique. Accordingly, a directional antenna would be selected that is configured to "bounce" jamming energy off of the terrain below. The antenna switch matrix 340-1 would receive a command to couple the appropriate output to the terrain bounce antenna.

Jamming subsystems 340-2 include a plurality of modules configured to perform different tasks. Some example jamming subsystems 340-2 may include radio frequency (RF) jamming subsystems such as a polarization module for cross-polarization, various modulators (e.g., for E/F-Band and I/J-Band), velocity gate pull-off/velocity deception units, range gate pull-off/range deception units, noise generators, repeaters, false target generators, and multi-technique deception units. Alternatively, jamming subsystems 340-2 may include infrared, laser, or satellite navigation jammers.

Figure 4:
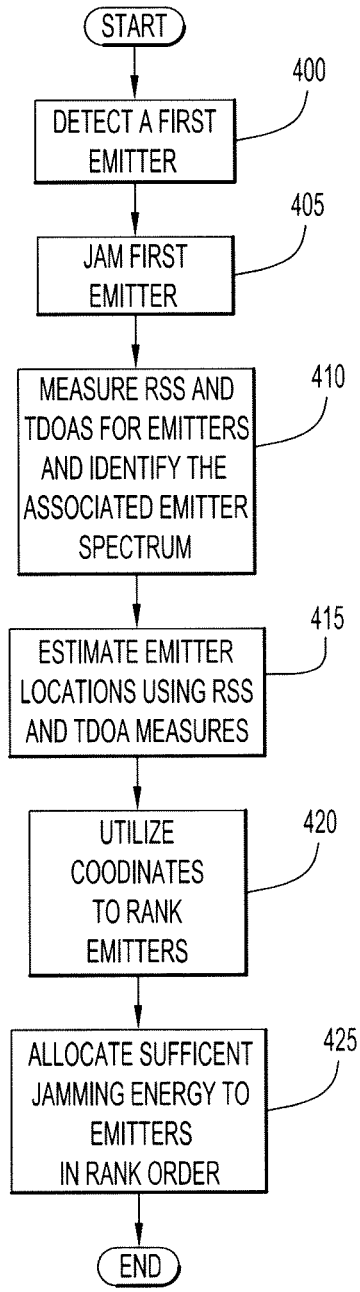
FIG. 4 is a procedural flow chart illustrating a manner in which radio frequency (RF) emitters are ranked and jammed according to an embodiment of the present invention.

The manner in which processor 350 (e.g., via one or more processing modules) determines the geolocation of a radio frequency (RF) emitter based on received signal strength (RSS) or time difference of arrival (TDOA) measurements at various locations and performs emitter analysis is illustrated in FIG. 4. Initially, a first emitter is detected at step 400. Tracking system 115 was previously turned off or in a standby mode, and is now operational. The mobile sensor 100 detects the tracking system 115 and begins to jam the first detected emitter (tracking system 115) at step 405. At first, the mobile sensor 100 may use a typical blind and offensive approach using omnidirectional jamming to mitigate tracking system 115 radar tracking capability.

In the mean time, mobile sensor 100 continues to collect data (e.g., received signal strengths (RSSs) and spectrum use data) from other emitters at step 410. The data may include information on emitters collected while on the predetermined path 110 or for any new emitters that start transmitting. As soon as tracking system 115 detects presence, command post 120 may initiate deployment 125 at which time deployment 125 will become emitters of interest as well.

Mobile sensor 100 performs geolocation of all detected emitters using locations modules 350-1 at step 415 (e.g., using the energy based Least Mean Square (LMS) and/or time difference of arrival (TDOA) techniques described above). Location modules 350-1 may generate combined geolocation results by combining the energy based geolocation data with the time difference of arrival geolocation (TDOAG) data. Combined geolocation results (e.g., geolocation data 350-2) depend on many factors such as the sensor platform-to-emitter range, platform heading, relative platform-emitter geometry, platform/emitter speed, number of measurements (elapsed time), signal types, interference, radio frequency (RF) propagation effects, antenna resources, and the accuracy of the sensor. In addition, not all sensor platforms have the same antenna and processing resources, so each platform type may have different sensor measures with different quality of measures. The quality of measures will be used to optimally estimate the emitter locations.

In general, the algorithms may use energy-based geolocation for narrowband and short-duration signals, and time difference of arrival (TDOA) geolocation for broadband and long duration signals (e.g., time difference of arrival (TDOA) geolocation may be better suited for emitters in urban areas, while a combination of energy-based and time difference of arrival (TDOA) geolocation may be better suited for emitters in open terrain). Accordingly, geolocation data 350-2 may be a weighted combination of energy-based and time difference of arrival (TDOA) geolocation information (e.g., geolocation=energy-based geolocation*$w_1$+TDOA geolocation*$w_2$), where the weight values or vectors ($w_1$, $w_2$) are in the range from zero to one, and are assigned to account for signal characteristics, signal errors, terrain or environment, and the above-listed factors.

The geolocation data are fed back to processor 350 or otherwise made available to emitter analysis module 350-3. The emitter analysis module 350-3 uses correlation module 350-4 to correlate emitter characteristics and geolocation with known intelligence and mapping data. Along with correlation module 350-4, mobile sensor 100 uses spectrum analysis module 350-5 to further classify emitters of interest based on spectrum use data. The combined information obtained from location modules 350-1 (e.g., range and azimuth), correlation module 350-4 and spectrum analysis module 350-5 is used to rank emitters in order of importance at step 420.

The emitter rank is submitted to the processor 350 for further processing. Once the emitters are ranked, sufficient jamming energy is allocated for each emitter in rank order at step 425. Processor 350 includes an energy allocation module 350-9 to determine the amount of jamming energy required to jam a particular emitter. The amount of energy is based on the distance from the jammer to the emitter, frequency band to be jammed, or other known energy allocation methods. For example, radio frequency (RF) power is known to dissipate in proportion distance or range (r) from the emitter raised to the fourth power (a fourth-power law ($r^4$)), environmental conditions aside. Accordingly, the range is an important criterion for determining the amount of jamming energy that will reach an emitter of interest, and therefore, range is an important emitter ranking variable. For closer ranges simpler square-power law ($r^2$) power formula may be used. Other power laws may be appropriate depending on range and emitter/environmental characteristics. The energy allocation module 350-9 uses the emitter ranking and energy allocation strategy described above to allocate enough jamming energy to the highest ranking emitter until the emitter is mitigated, then allocate energy to the next highest emitter, and the next, etc., until the jamming energy is exhausted (when jamming subsystem amplifiers have reached an internal power limit or duty cycle limit).

Since various emitters may operate in different frequency bands, different types of jamming equipment and associated antennas may be employed for each frequency band. Each frequency band has its own useful characteristics. In general, the higher the frequency in use is, the shorter the range and the smaller the antenna becomes, while accuracy improves (disregarding atmospheric effects and power limitations). To assist in equipment selection, processor 350 includes a jamming subsystem selection module 350-10 and an associated antenna selection module 350-11. The jamming subsystem selection module 350-10 and the antenna selection module 350-11 allow the processor 350 to select the appropriate jamming subsystems 340-2 and configure the antenna switch matrix 340-1 for jamming system 340. Processor 350 may be a part of jamming system 340 or communicate configuration information to jamming system 340.

To further assist operations, processor 350 employs tracking module 350-6 as part of emitter analysis module 350-3. Tracking module 350-6 tracks the locations and movements of emitters (e.g., emitters 115, 120, and 125) via location modules 350-1. The location information may be processed by processor 350 and forwarded to another system via interface unit 370 and command and control transceiver 390. The location information may be processed to direct or control a vehicle or other platform to an emitter at a location of interest (e.g., to provide assistance at that location, etc.).

Further, the location information may be utilized to generate an image of the area and indicate the emitter locations by way of situational awareness (SA) module 350-7. Situational awareness (SA) module 350-7 may further exchange information with correlation module 350-4 to develop an overall "big picture" of the current environment. Situational awareness (SA) module 350-7 may also collect information from other sensors and provide information to other sensors or a central processing station using command and control transceiver 390.

Mobile sensor 100 may be designated as a slave resource, or as a master processing center that acts as an aggregation center for situational awareness (SA) information. When designated as a master processing center, mobile sensor 100 collects emitter information and situational awareness (SA) module 350-7 assesses the current environment as well as the locations and capabilities of other resources. Situational awareness (SA) module 350-7 uses an emitter allocation module 350-8 to allocate resources from various other systems against emitters, thereby sharing load and force protection across multiple platforms. For example, allocation module 350-8 may allocate emitter 115 to mobile sensor 100, emitter 120 to another jamming platform, and emitter 125 to still another jamming platform. The allocated emitters are disseminated to the other jamming resources using command and control transceiver 390.

As a slave resource, mobile sensor 100 receives allocated emitters from another emitter allocation processing center. Mobile sensor 100 receives emitter allocation information (e.g., mobile sensor 100 may be designated as the jammer of choice for mobile command post 120 or to deployment 125) via command and control transceiver 390. In certain situations, mobile sensor 100 may override the emitter allocation information when its situational awareness (SA) module 350-7 deems another emitter to be a higher priority. This type of situation may occur due to the dynamic nature of the environment where new emitters may come on line before a central emitter allocation center has time to assess a new emitter (e.g., due to network latency).

Figure 5:
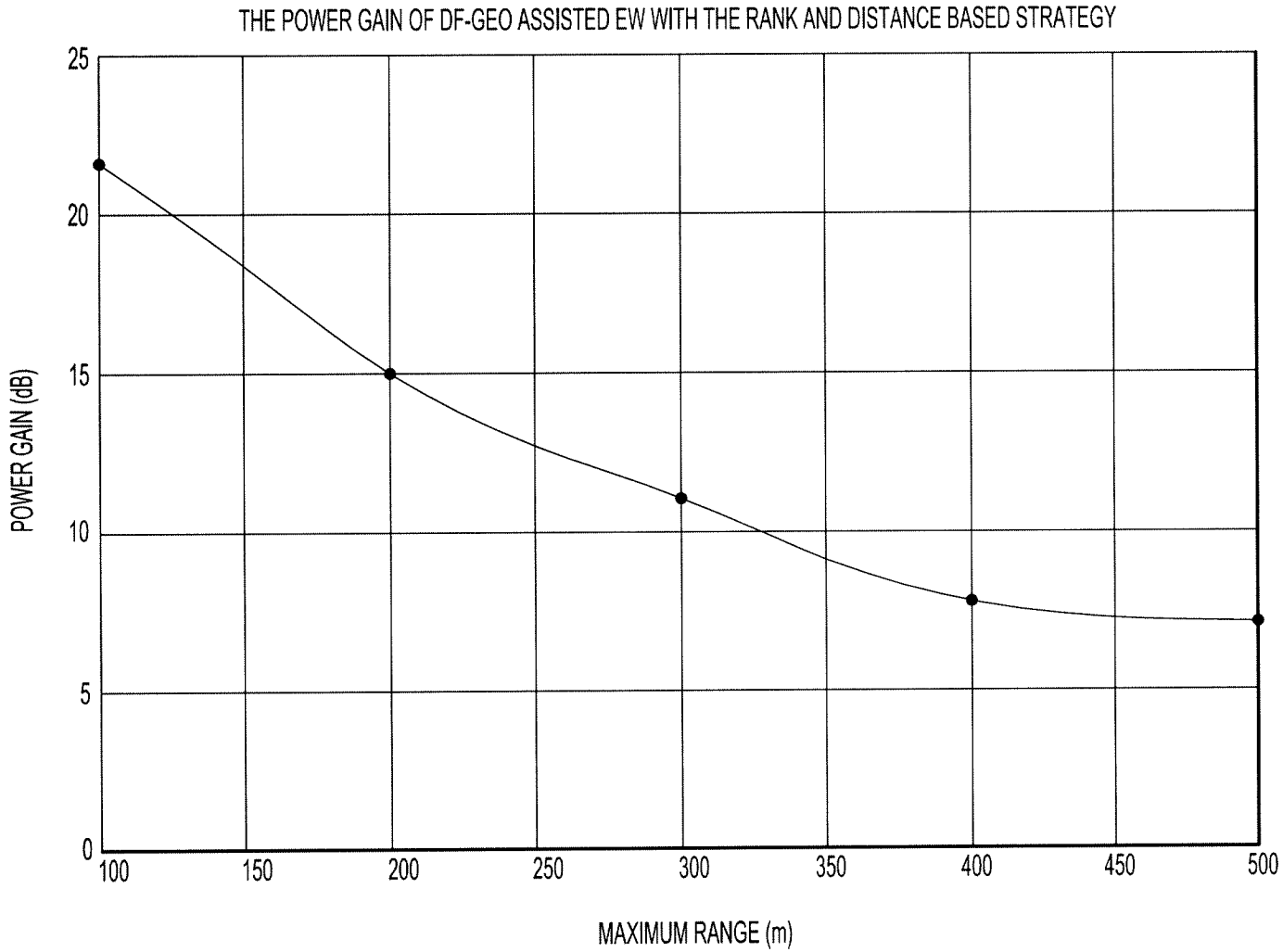
FIG. 5 is a graphical representation of simulation results for an embodiment of the present invention illustrating the relationship between power gain and the distance to an emitter of interest.

The emitter ranking and distance-based techniques of a present invention embodiment employing small unmanned air vehicles (UAV) has been modeled and simulated using MATLAB tools available from Mathworks, Inc. of Natick, Mass. A graphical illustration of the simulation results providing the relationship between power gain (dB) and the range (meters) to an emitter of interest is illustrated in FIG. 5. The graph shows an average power saving of approximately 7 to 22 dB over conventional omni-directional jamming systems. For each sample of the simulation, the emitter locations are randomly generated, and the $4^{th}$ power propagation law is assumed. The relative power saving shown in FIG. 5 was obtained by averaging the power saving over 1000 random simulation runs.

It will be appreciated that the embodiments described above and illustrated in the drawings represent only a few of the many ways of implementing a system and method for allocating jamming energy based on three-dimensional geolocation of emitters.

The environment of the present invention embodiments may include any quantity of mobile sensors and emitters. The emitters may be implemented by any quantity of any conventional or other devices emitting radio frequency (RF) or any other suitable energy signals (e.g., energy signals in any suitable bands (e.g., infrared, microwave, optical, etc.)). The emitters may be located at any quantity of any desired locations within the three-dimensional space of the environment. The mobile sensors may be implemented by any quantity of any conventional or other mobile or stationary vehicle or platform (e.g., unmanned air vehicle (UAV), air vehicle, ground vehicle, platform or structure mounted at a location or on a vehicle, etc.), and may include any quantity of any conventional or other sensing device (e.g., RF or other sensor, etc.). The mobile sensors may each measure any desired characteristics of emitted signals at any one or more locations within the environment.

The jamming systems and subsystems may be implemented by any quantity of any conventional or other jamming devices and configured to jam or disable the use of radio frequency (RF) or any other signals (e.g., infrared, optical, etc.). The jamming systems and subsystems may implement any quantity of any type of antenna (e.g., omni-directional, directional, smart, etc.). Jamming subsystem selection techniques are well known for the jamming system in use.

The pre-planned path may traverse any desired locations within the environment, where any quantity of measurements may be obtained during traversal of the path. Further, measurements may be obtained at any locations residing within a specified offset or range from the pre-planned path. Alternatively, the path may be determined in random fashion. The mobile sensors may use situational awareness (SA) or other techniques to override a pre-planned path.

The emitter detection antenna may be implemented by any conventional or other antenna (e.g., omni-directional, directional, etc.) configurable to receive the signals emitted from the one or more emitters. The receiver may be implemented by any conventional or other receiving device capable of receiving the emitted radio frequency (RF) or other energy signals. The radiometer may be implemented by any conventional or other device to measure the energy or received signal strength (RSS) or other characteristics of a received signal. The radiometer may be included within or separate from the receiver.

The processor may be implemented by any quantity of any conventional or other computer systems or processing units (e.g., a microprocessor, a microcontroller, systems on a chip (SOCs), fixed or programmable logic, etc.), and may include any commercially available or custom software (e.g., communications software, location modules, etc.).

It is to be understood that the software (e.g., location modules, emitter analysis modules, etc.) for the processor of the present invention embodiments may be implemented in any desired computer language and could be developed by one of ordinary skill in the computer arts based on the functional descriptions contained in the specification and flow charts illustrated in the drawings. Further, any references herein of software performing various functions generally refer to computer systems or processors performing those functions under software control. The processor of the present invention embodiments may alternatively be implemented by any type of hardware and/or other processing circuitry. The various functions of the processor may be distributed in any manner among any quantity of software modules or units, processing or computer systems and/or circuitry, where the computer or processing systems may be disposed locally or remotely of each other and communicate via any suitable communications medium (e.g., LAN, WAN, Intranet, Internet, hardwire, modem connection, wireless, satellite, tactical data links, etc.). For example, the functions of the present invention embodiments may be distributed in any manner among the processor, receiver, jamming system, and/or external devices. The software and/or algorithms described above and illustrated in the flow charts may be modified in any manner that accomplishes the functions described herein. In addition, the functions in the flow charts or description may be performed in any order that accomplishes a desired operation.

The software of the present invention embodiments (e.g., location modules, energy allocation module, etc.) may be available on a program product apparatus or device including a recordable or computer usable medium (e.g., magnetic or optical mediums, magneto-optic mediums, floppy diskettes, CD-ROM, DVD, memory devices, etc.) for use on stand-alone systems or systems connected by a network or other communications medium, and/or may be downloaded (e.g., in the form of carrier waves, packets, etc.) to systems via a network or other communications medium. Further, the tangible recordable or computer usable medium may be encoded with instructions or logic to perform the functions described herein (e.g., embedded logic such as an application specific integrated circuit (ASIC), digital signal processor (DSP) instructions, software that is executed by a processor, etc.).

The memory may be included within or external of the processor, and may be implemented by any conventional or other memory unit with any suitable storage capacity and any type of memory (e.g., random access memory (RAM), read only memory (ROM), etc.). The memory may store any desired information for performing the geolocation technique of present invention embodiments (e.g., location modules, data, etc.). The command and control transceiver may be implemented by any quantity of any conventional or other communications device (e.g., wireless communications device, wired communication device, etc.), and may be configured for communication over any desired network (e.g., wireless, cellular, LAN, WAN, Internet, Intranet, VPN, etc.).

The interface unit may be implemented by any quantity of any conventional or other interfaces for integrating any or all of the various communications components of the receiver, processor, jamming system, and command and control transceiver. The interface unit may translate to and from any communications or network protocol.

Present invention embodiments may employ any quantity of variables or equations to determine the estimated location of one or more emitters, provided that the quantity of equations is greater than or equal to the quantity of unknown variables. Further, any conventional or other techniques may be employed to produce the location estimate with minimal error (e.g., Least Mean Square (LMS), etc.). The equations may be represented in any desired form (e.g., matrix form, vectors, scalars, etc.), and be solved in any desired fashion to enable determination of the emitter location. The location estimate may be produced and/or converted to any desired form, and may be provided with respect to any desired reference (e.g., coordinates within the space, longitude and latitude indications, GPS coordinates, etc.).

The resulting location estimate may be utilized for any suitable applications in addition to emitter analysis (e.g., generation of a map image of the area, vehicle or other platform guidance systems to direct the vehicle or platform toward or away from areas, radar or other detection systems, etc.).

Emitters may be ranked by any number of factors including distance from the jamming platform, proximity to friendly forces (which may cause harmful interference to friendly emitters), radio frequency (RF) spectrum and modulation employed by the emitter, azimuth or line of bearing (LOB), emitter elevation, or intelligence information. The factors may be combined in any suitable fashion (e.g., a weighted average or scale) to obtain a current emitter ranking. The ranking may be updated at any suitable interval (e.g., periodically or when new information is received over a communications data link).

Jamming energy may be allocated to a particular emitter based on distance from the jamming platform, frequency band and radio frequency (RF) modulation scheme used by the emitter, azimuth or line of bearing (LOB), emitter elevation, atmospheric conditions (e.g., rain, fog, dust, solar emissions, etc.), or emitter characteristics (e.g., certain emitters may be known to have weaknesses that can be exploited). Jamming energy allocation also takes into account onboard systems limitations such as power, average power, peak or burst power, and duty cycle constraints. Jamming energy allocation and distribution are known in the art for the type of jamming and jamming systems in use.

The various indices (e.g., i, N, etc.) are preferably integers, but may be any types of numbers with any suitable numeric ranges.

It is to be understood that the terms "top", "bottom", "front", "rear", "side", "height", "length", "width", "upper", "lower", "vertical" and the like are used herein merely to describe points of reference and do not limit the present invention to any particular orientation or configuration.

The various modules (e.g., emitter analysis module, energy allocation module, etc.) may be implanted using any number or manner of conventional or other techniques appropriate to the functions of a corresponding module (e.g., jamming subsystem selection module may use cross-polarization, velocity gate pull-off, etc.). It is to be understood that any of the modules, jamming systems, jamming subsystems, antennas, or other software or hardware may be configured to implement the techniques described herein.

From the foregoing description, it will be appreciated that the invention makes available a novel system and method for allocating jamming energy based on three-dimensional geolocation of emitters using received signal strength (RSS) or time difference of arrival (TDOA) measurements, wherein locations of radio frequency (RF) emitters in a three-dimensional space are determined based on energy, received signal strength (RSS) measurements, or TDOAs of the emitters at various locations. The locations, spectrum, and other information are used to rank an emitter for subsequent jamming energy allocation.

Having described example embodiments of a new and improved system and method for emitter ranking and energy allocation based on a three-dimensional geolocation of emitters using a energy-based received signal strength (RSS), or time difference of arrival (TDOA) measurements, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A system for locating a plurality of emitters and transmitting jamming signals at said plurality of emitters within an area comprising:

a receiver to receive signals transmitted by said plurality of emitters and obtain measurements of said received signals at a plurality of different locations within said area;

a processor to process said measurements to locate said plurality of emitters within said area, wherein said processor includes:

a location module to process said measurements and determine three-dimensional locations of said plurality of emitters within said area based on relationships of distances between said plurality of emitters and each of said plurality of locations, wherein said measurements are proportional to said distances; and an emitter analysis module to determine an emitter type associated with each emitter and rank said plurality of emitters based on said emitter type and said three-dimensional locations of said plurality of emitters within said area; and a transmitter to transmit said jamming signals at said plurality of emitters based on said three-dimensional locations of said plurality of emitters within said area, wherein said transmitter is configured to generate an amount of jamming energy, transmit sufficient energy from the amount of jamming energy at a first of the plurality of emitters and transmit remaining energy from the amount of jamming energy among remaining ones of the plurality of emitters, and wherein said transmitter transmits jamming signals at successive ones of said plurality of emitters in order of said rank until said jamming energy is exhausted.

2. The system of claim 1, wherein said location module includes:

a variable module to determine said three-dimensional locations by solving a set of simultaneous equations relating to said distances, wherein said set of simultaneous equations include unknown variables representing coordinates of said three-dimensional locations of said plurality of emitters within said area.

3. The system of claim 2, wherein said measurements include energy measurements of said signals transmitted by said plurality of emitters based on a received signal strength of said signals transmitted by said plurality of emitters.

4. The system of claim 2, wherein said measurements include time difference of arrival measurements of said signals transmitted by said plurality of emitters based on reception times of said signals transmitted by said plurality of emitters, said reception time differences of arrival being proportional to said distances.

5. The system of claim 1, wherein said emitter analysis module includes:

a correlation module to identify an emitter of interest by geo-spatially correlating said three-dimensional locations of said plurality of emitters within said area with known information for said area.

6. The system of claim 1, wherein said emitter analysis module includes:

a tracking module to generate tracking data for said plurality of emitters based on said three-dimensional locations of said plurality of emitters within said area.

7. The system of claim 6, wherein said emitter analysis module includes:

a situational awareness module to generate situational awareness data for said area based on said tracking data.

8. The system of claim 7, further comprising:

a transceiver to transmit and receive situational awareness data to or from another platform; and wherein said situational awareness module combines situational awareness data for said area with situational awareness data for an area associated with said other platform to produce combined situational awareness data.

9. The system of claim 8, wherein said situational awareness module includes:

an emitter allocation module to allocate emitters, subject to said jamming signals, between said system and said other platform based on said combined situational awareness data.

10. The system of claim 1, wherein said emitter analysis module includes:

an energy allocation module to allocate jamming signal energy for transmission at each of said plurality of emitters.

11. The system of claim 10, wherein said energy allocation module is configured to allocate sufficient jamming signal energy for transmission at successive emitters in rank order until transmission energy is exhausted.

12. The system of claim 1, further comprising:

a plurality of antennas; and wherein said emitter analysis module includes:

an antenna switching module to select one or more antennas for transmitting said jamming signals at each of said plurality of emitters based on antenna characteristics of each of said plurality of antennas.

13. The system of claim 1, wherein said emitter analysis module includes:

a spectrum analysis module to determine a frequency band associated with each of said plurality of emitters; and said system further comprises:

a jamming subsystem selection module configured to select one or more jamming subsystems based on said frequency bands;

a first jamming subsystem, wherein said transmitter is part of said first jamming subsystem for transmitting jamming signals within a first frequency band; and a second jamming subsystem for transmitting jamming signals within a second frequency band.

14. A method for locating a plurality of emitters and transmitting jamming signals at said plurality of emitters within an area comprising:

(a) receiving signals transmitted by said plurality of emitters via a receiver and obtaining measurements of said received signals at a plurality of different locations within said area;

(b) processing said measurements, via a processor, and determining three-dimensional locations of said plurality of emitters within said area based on relationships of distances between said plurality of emitters and each of said plurality of locations, wherein said measurements are proportional to said distances, and wherein step (b) further includes:

(b.1) processing said measurements and determining three-dimensional locations of said plurality of emitters within said area;

(b.2) determining an emitter type associated with each emitter; and (b.3) ranking said plurality of emitters based on said emitter type and said three-dimensional locations of said plurality of emitters within said area; and (c) transmitting said jamming signals at said plurality of emitters based on said three-dimensional locations of said plurality of emitters within said area, wherein transmitting includes transmitting sufficient energy from an amount of jamming energy at a first of the plurality of emitters, and transmitting remaining energy from the amount of jamming energy among remaining ones of the plurality of emitters, and wherein said jamming signals are transmitted at successive ones of said plurality of emitters in order of said rank until said jamming energy is exhausted.

15. The method of claim 14, wherein step (b) further includes:

determining said three-dimensional locations by solving a set of simultaneous equations relating to said distances, wherein said set of simultaneous equations includes unknown variables representing coordinates of said three-dimensional locations of said plurality of emitters within said area.

16. The method of claim 15, wherein said measurements include energy measurements of said signals transmitted by said plurality of emitters based on a received signal strength of said signals transmitted by said plurality of emitters.

17. The method of claim 15, wherein said measurements include time difference of arrival measurements of said signals transmitted by said plurality of emitters based on reception times of said signals transmitted by said plurality of emitters, said reception time differences of arrival being proportional to said distances.

18. The method of claim 14, wherein step (b) further includes:

(b.4) identifying any of said plurality of emitters as an emitter of interest by geo-spatially correlating said three-dimensional locations of said plurality of emitters within said area with known information for said area.

19. The method of claim 18, wherein step (b) further includes:

(b.5) generating tracking data for said plurality of emitters based on said three-dimensional locations of said plurality of emitters within said area.

20. The method of claim 19, wherein step (b) further includes:

(b.6) generating situational awareness data for said area based on said tracking data.

21. The method of claim 20, further comprising:

(d) transmitting or receiving situational awareness data to or from another platform; and wherein step (b) further includes:

(b.7) combining situational awareness data for said area with situational awareness data for an area associated with said other platform to produce combined situational awareness data.

22. The method of claim 21, wherein step (b) further includes:

(b.8) allocating emitters subject to jamming between platforms based on said combined situational awareness data.

23. The method of claim 14, wherein step (b) further includes:

(b.4) allocating jamming signal energy for transmission at each of said plurality of emitters.

24. The method of claim 23, wherein allocating jamming signal energy comprises allocating sufficient jamming signal energy for transmission at successive emitters in rank order until transmission energy is exhausted.

25. The method of claim 14, wherein step (b) further includes:

(b.4) selecting one or more antennas from a plurality of antennas for transmitting said jamming signals at each of said plurality of emitters based on antenna characteristics of each of said plurality of antennas.

26. The method of claim 14, wherein step (b) further includes:

(b.4) analyzing the spectrum of said received signals to determine a frequency band associated with each of said plurality of emitters; and (b.5) selecting one or more jamming subsystems based on said frequency bands associated with each of said plurality of emitters.

27. The system of claim 1, wherein said measurements include energy measurements of said signals transmitted by said plurality of emitters based on a received signal strength of said signals transmitted by said plurality of emitters and said measurements include time difference of arrival measurements of said signals transmitted by said plurality of emitters based on reception times of said signals transmitted by said plurality of emitters, said reception time differences of arrival being proportional to said distances, and wherein said location module processes said measurements and determines three-dimensional locations of said plurality of emitters within said area based on said energy measurements and said time difference of arrival measurements.

28. The method of claim 14, wherein said measurements include energy measurements of said signals transmitted by said plurality of emitters based on a received signal strength of said signals transmitted by said plurality of emitters and said measurements include time difference of arrival measurements of said signals transmitted by said plurality of emitters based on reception times of said signals transmitted by said plurality of emitters, said reception time differences of arrival being proportional to said distances, and wherein step (b) further includes:

(b.1) processing said measurements and determining three-dimensional locations of said plurality of emitters within said area based on said energy measurements and said time difference of arrival measurements.

* * * * *